US008006834B2

(12) United States Patent
Marcinkowski

(10) Patent No.: US 8,006,834 B2
(45) Date of Patent: Aug. 30, 2011

(54) CO-PACKAGED ARTICLES

(75) Inventor: Stanley Michael Marcinkowski, Peabody, MA (US)

(73) Assignee: The Gillette Company, Boston, MA (US)

( * ) Notice: Subject to any disclaimer, the term of this patent is extended or adjusted under 35 U.S.C. 154(b) by 8 days.

(21) Appl. No.: 12/644,172

(22) Filed: Dec. 22, 2009

(65) Prior Publication Data

US 2011/0147241 A1 Jun. 23, 2011

(51) Int. Cl.
*B65D 69/00* (2006.01)

(52) U.S. Cl. ..... 206/232; 206/469; 206/471; 206/806

(58) Field of Classification Search ..... 206/216, 206/223, 232, 351, 361, 362, 461, 466, 467, 206/469, 471, 558, 703, 705, 806, 459.5
See application file for complete search history.

(56) References Cited

U.S. PATENT DOCUMENTS

| | | | | |
|---|---|---|---|---|
| 3,288,280 | A * | 11/1966 | Bostrom | 206/461 |
| 3,401,863 | A | 9/1968 | Earl | |
| 3,615,005 | A * | 10/1971 | Segel et al. | 206/469 |
| 4,485,920 | A * | 12/1984 | Skylvik | 206/468 |
| 4,577,757 | A * | 3/1986 | Hustad et al. | 206/461 |
| 4,619,364 | A * | 10/1986 | Czopor, Jr. | 206/461 |
| 5,657,873 | A | 8/1997 | Hustad et al. | |
| 5,657,874 | A | 8/1997 | Hustad et al. | |
| 5,922,376 | A | 7/1999 | Privert | |
| 6,510,943 | B2 | 1/2003 | Okin et al. | |
| 6,648,140 | B2 * | 11/2003 | Petricca | 206/356 |
| 7,410,056 | B2 | 8/2008 | Cafferata et al. | |
| D586,623 | S | 2/2009 | Dunn | |
| D598,742 | S | 8/2009 | Arevalo et al. | |
| 2005/0061759 | A1 * | 3/2005 | Doucette | 206/461 |
| 2006/0278561 | A1 * | 12/2006 | Schierlmann | 206/575 |
| 2008/0217199 | A1 * | 9/2008 | Burress et al. | 206/470 |
| 2009/0039079 | A1 * | 2/2009 | Lipinski et al. | 220/23.4 |
| 2009/0159483 | A1 | 6/2009 | Hinze et al. | |

FOREIGN PATENT DOCUMENTS

| | | |
|---|---|---|
| DE | 20 2004 005 446 U1 | 9/2005 |
| GB | 1053868 | 1/1967 |

OTHER PUBLICATIONS

PCT International Search Report with Written Opinion in corresponding Int'l appln. PCT/US2010/060626 dated May 4, 2011.

* cited by examiner

*Primary Examiner* — Luan K Bui
(74) *Attorney, Agent, or Firm* — John M. Lipchitz; Kevin C. Johnson; Steven C. Miller

(57) ABSTRACT

A pack for a co-packaged article with an inner flange member and an outer flange member. A first cavity is defined by the inner flange member and the outer flange member. The first cavity has an outer surface and a first internal wall. A second cavity is defined by the inner flange member and the outer flange member. The second cavity has an outer surface and a second internal wall spaced apart from the first internal wall. The second internal wall has at least one protrusion with a first position and a second position. The protrusion is spaced apart from the first internal wall in the first position and contacts the first internal wall in the second position limiting inward flexing of the first and second cavities toward each other.

19 Claims, 3 Drawing Sheets

CO-PACKAGED ARTICLES

FIELD OF THE INVENTION

The present invention relates to co-packaged articles for holding and displaying a plurality of products within a single pack and more particularly, to thermoformed blister packs with improved rigidity.

BACKGROUND OF THE INVENTION

A blister pack is a term for pre-formed plastic packaging that is often used for holding and displaying consumer goods. The two primary components of a blister pack are the cavity or pocket made from a formable web, (e.g., plastic) and a lid (e.g., paperboard or plastic). The formed cavity or pocket contains the product and the lid seals the product within the cavity. Other types of blister packs may consist of carded packages where the products are contained between a paperboard card and clear pre-formed plastic (e.g., polyvinylchloride). The consumer can easily examine the product through the transparent plastic. The plastic shell is vacuum -formed around a mold so it can contain the item snugly. The card may be brightly colored and designed depending on the item inside, and the pre-formed plastic is affixed to the card using heat and pressure to activate an adhesive (heat seal coating) on the blister card. The adhesive is strong enough so that the pack may hang on a peg, but weak enough so that the package can be easily opened. The card may also have a perforated window for access. A more secure package is known as a clamshell. It is often used to deter package pilferage for small high-value items such as consumer electronics. It consists of either two pre-formed plastic sheets or one sheet folded over onto itself and fused at the edges. They are usually designed to be difficult to open by hand so as to deter tampering. A pair of scissors or a sharp knife is often required to open them (although often coming in the same package). Care must be used to safely open some of these packages.

Blister packs are typically thermoformed. Thermoforming is a manufacturing process where a plastic sheet is heated to a pliable forming temperature, formed to a specific shape in a mold, and trimmed to create a usable product. The sheet (or film when referring to thinner gauges and certain material types), is heated in an oven to a high-enough temperature that it can be stretched into or onto a mold and cooled to a finished shape. Thin-gauge thermoforming is primarily the manufacture of disposable cups, containers, lids, trays, blisters, clamshells, and other products for the food, medical, and general retail industries. For high-volume applications, very large production machines are utilized to heat and form the plastic sheet and trim the formed parts from the sheet in a continuous high-speed process, and can produce many thousands of finished parts per hour depending on the machine and mold size and the size of the parts being formed. Thermoformed blister packs for large scale production typically have limited strength and rigidity because of the added manufacturing costs associated with thermoforming more rigid materials or thicker plastic sheets.

Bundling is presently defined as selling two or more different products (e.g., products having different contents, weights, or geometries) together at a single price. Bundling items together gives the unfamiliar consumer the chance to use a product that they would normally not buy as an individual item. Bundling can also provide an opportunity for a company to get new products out into the market. In some cases, consumers may be just looking for one certain game, program, article, etc. For example, if related items are bundled together for a lower price than buying both items separately, then it could persuade consumers to purchase the bundled package. Even if the consumer does not have any plans to use the extra item or items within the bundled package, there is always that slight chance that it could be of some use to them in the future. For example, if the consumer was tired of, or completed a game, then they would be getting more value by playing the other game that was included within the bundle and provided at no, or very little, extra cost to them.

Furthermore, producers of consumer products may offer all their products separately or may choose to bundle them together. If the producer chooses to bundle the products together, it could result in reduced costs related to packaging, marketing, advertising, and the like. The reduce costs of excess packaging materials may also result in a more environmental conscience product (e.g., less plastic is needed to produce the bundled product than two separately packaged products). Bundling items together may also reduce the sales costs and in turn, yield higher profits since more people would be willing to purchase the bundle. Bundled products could also gain an advantage over competition by offering two or more items for a better price than the price of a competitor's single item. Bundling can also offer convenience to the consumer by locating related items together. By locating the two or more products together in a bundle, the consumer avoids the need to locate within the store the individual items, each at their own individual location. This not only saves the effort of locating the items but also the time required to move to each individual product location. This convenience can also be translated into the at-home experience for the consumer. If the products are purchased as a bundled package, there is a higher probability that the items will remain close to each other in the home thereby making it easier to locate them for current, or future, use.

Despite of the advantages of bundling, bundling does have some drawbacks. For example, bundling typically results in a larger and heavier final packaged product because more articles are required to be packaged together. If the structural integrity of the package is compromised, the contents may become damaged or the package may become easier to breach for pilfering. Certain products are difficult to bundle because the individual products must be kept separated from each other because one product may be detrimental to the performance of the other product. For example, a container of shampoo may potentially leak and damage a powered device that is located within the same package. Bundling also increases the weight of the final packaged product, which may adversely influence package integrity. Furthermore, the consumer may perceive the co-packaged article as having inferior quality if the final package appears to be fragile or flimsy. For these reasons, co-packaged articles are often disposed within a thermoformed tray that is placed in a box. This method of displaying may not be as economical and versatile as some other packaging methods, but has proven to be a secure way co-packaging articles.

SUMMARY OF THE INVENTION

In one aspect, the invention features, in general, a pack for a co-packaged article having an inner flange member and an outer flange member. A first cavity is defined by the inner flange member and the outer flange member. The first cavity has an outer surface and a first internal wall. A second cavity is defined by the inner flange member and the outer flange member. The second cavity has an outer surface and a second internal wall spaced apart from the first internal wall. The second internal wall has at least one protrusion with a first position and a second position. The protrusion is spaced apart from the first internal wall in the first position and contacts the first internal wall in the second position limiting inward flexing of the first and second cavities toward each other.

In another aspect, the invention features, in general, a co-packaged article having a first product, a second product, and a pack having an outer flange member defining a first cavity dimensioned to receive the first product and a second cavity dimensioned to receive the second product. The first cavity has an outer surface and a first internal wall with at one least one protrusion projecting laterally from the first internal wall. The second cavity has an outer surface and a second internal wall spaced apart from the first internal wall. The second internal wall has at least one protrusion projecting laterally toward the protrusion of the first internal wall. A cover is joined to the outer flange member and a label interconnects the outer surface of the first and second cavities.

In yet another aspect, the invention features, in general, a pack having an inner flange member and an outer flange member. A first cavity is defined by the inner flange member and the outer flange member. The first cavity has an outer surface and a first internal wall. A second cavity is defined by the inner flange member and the outer flange member. The second cavity has an outer surface and a second internal wall spaced apart from the first internal wall. The second internal wall has at least one protrusion projecting laterally toward and spaced apart from the first internal wall. A label interconnects the outer surface of the first and second cavities.

DETAILED DESCRIPTION OF THE INVENTION

Figure 1:
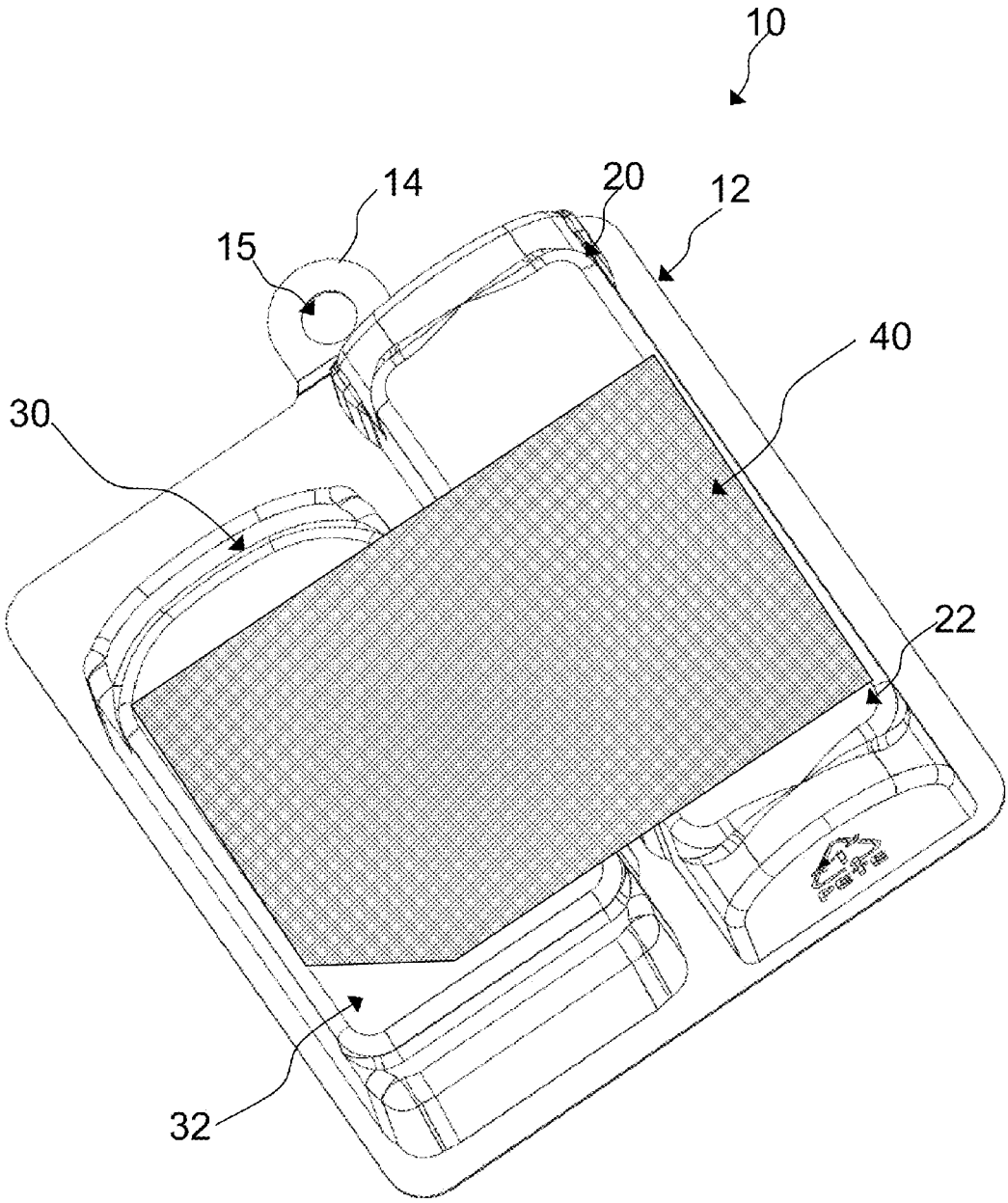
FIG. 1 is a bottom perspective view of a co-packaged article.

Referring to FIG. 1, one possible embodiment of the present invention is shown illustrating a co-packaged article 10, which may be mounted to a hanging display (e.g., a peg board). It is understood that the co-packaged article 10 may include any type of blister packs, including, but not limited to card blisters and clamshells. Hanging displays, such as peg boards offer increased versatility for presenting articles to consumers. For example, pegboard racks that revolve or spin work extremely well for stores that have limited floor space. Furthermore, displaying co-packaged products on a peg board offers a competitive advantage over non co-packaged products that are displayed next to the co-packaged product. If a consumer sees two similar products displayed next to each other on a peg board display, the consumer is more likely to choose the co-packaged product because of the perceived greater value. The co-packaged product also stands out compared other products that are merchandized as a single product. A hanging display, such as a peg board, increases the versatility of packaging design because a flat surface is not needed to display the package on a shelf. This versatility allows for even more creative package designs, thus allowing the article displayed on the peg board to stand out even further from competitive products.

In certain embodiments, the co-packaged article 10 may include a pack 12 with a hanging member 14 to facilitate the displaying the co-packaged article 10 on a hanging display. The hanging member 14 may have an opening 15 extending therethrough that is dimensioned to receive a peg or hook of a peg board style display. The opening 15 may be circular, a slot, or any other geometry known to those skilled in the art for easy placement of the pack 12 on a peg or hook. The hanging member 14 may have other configurations, such as a hook, to facilitate the mounting of the co-packaged article 10 to a string or wire. The hanging member 14 may be integral with the pack 12 or may be a separate member that is joined (e.g., adhesives) to the pack 12. Although the opening 15 is shown extending through the hanging member 14, it is understood that the hanging member 14 is part of the pack 12 and the opening 15 may extend directly through the pack 12. In other embodiments, the co-packaged article 10 may not have a hanging member 14 (e.g., the co-packaged article 10 may be displayed on a store shelf and not on a peg board).

FIG. 1 illustrates a bottom perspective view of the co-packaged article 10. As will be explained in greater detail below, the pack 12 of the co-packaged article 10 may include a first cavity 20 and a second cavity 30 for holding and displaying one or more products. It is understood that more cavities may be used for co-packaging three or more products. The first and second cavities 20 and 30 may each have an outer surface 22 and 32, respectively. In certain embodiments, the outer surfaces 22 and 32 may be transparent or translucent such that a consumer can see the products disposed within the pack 12. Outward flexing of the cavities 20 and 30 may cause distortion of the pack 12, which may result in rupture of the pack 12 and damage to the contents of the pack. Furthermore, a flexible pack 12 may give the perception of poor quality to a consumer. A label 40 may be interconnect the first and second cavities 20 and 30 to limit outward flexing of the first and second cavities relative to each other. The label 40 may be joined (e.g., pressure sensitive adhesive) to the outer surfaces 22 and 32. The label 40 may interconnect the first and second cavities 20 and 30 by circumscribing the pack 12 (e.g., a ribbon tied around the pack 12). The label 40 may have a dual function, for example, the label 40 may improve the structural integrity of the pack 12 and also provide important information to the consumer. The outer surfaces 22 and 32 may be flat to improve the joining of the label 40 to the outer surfaces 22 and 32. The label 40 may minimize outward flexing of the first cavity 20 relative to the second cavity 30 by interconnecting the outer surfaces 22 and 32 of the respective cavities 20 and 30. The label 40 may be at least partially transparent and/or translucent so the consumer can see the first and second products 50 and 52. Alternatively, the label 40 may be opaque or include a reflective and/or holographic image. The label 40 may also contain graphics and other information to inform the consumer about the products disposed within the co-packaged article 10.

Figure 2:
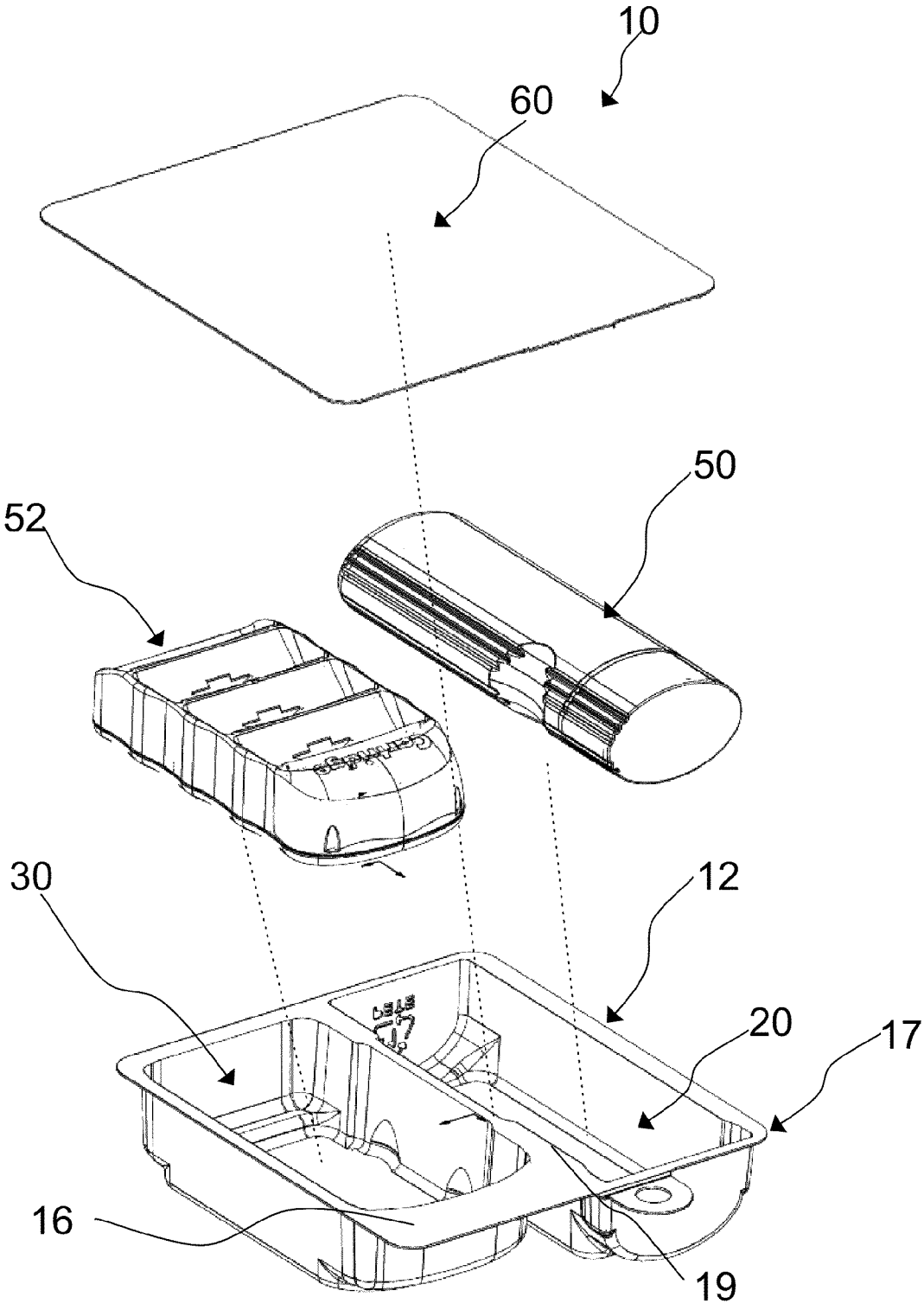
FIG. 2 is a perspective assembly view of the co-packaged article of FIG. 1.

Referring to FIG. 2, a perspective assembly view of the co-packaged article 10 is shown. The co-packaged article may include the pack 12, two or more products 50 and 52 disposed within the pack 12, and a cover 60 affixed to the pack 12. The first cavity 20 of the pack 12 may be dimensioned to receive the first product 50. The second cavity 30 may be dimensioned to receive the second product 52. The products 50 and 52 may be various types grooming and beauty items such as shaving cartridges, electric razors, tooth brushes, lotions, moisturizers, creams, ointments, or deodorants. The products 50 and 52 may also include electronic devices such as batteries, flashlights, cell phones and MP3 players. In certain embodiments, the first and second products 50 and 52 may be different. For example, the first product 50 may be a container of body wash and the second product 52 may be tray of razor cartridges. In other embodiments, the first and second products 50 and 52 may be similar, but may have different configurations. For example, the first product 50 may be 18 oz container of body wash and the second product 52 may be a 4 oz container of body wash. The first and second products 50 and 52 may have different weights, sizes, geometries, or may even be completely unrelated articles. For example, the first product 50 may contain a product having a liquid or chemical composition (e.g., a soap or deodorant) and the second product may be a mechanical product (e.g., razor or tooth brush). Although only a first and second products 50 and 52 are shown in FIG. 2, it is understood the co-packaged article 10 may have more than two products that are held and displayed by the pack 12.

The pack 12 may have an outer flange member 16 that defines the first cavity 20 and the second cavity 30. The outer flange member 16 may extend continuously around an outer perimeter 17 of the pack 12 to provide an area for the cover 60 to seal against. The outer flange member 16 may include at least one inner flange member 19 that separates the products 50 and 52. The inner flange member 19 may also provide an additional area for the cover 60 to seal against. The cover 60 may be affixed (e.g., heat sealing or adhesive) to the outer flange member 16 and/or the inner the flange member 19 of the pack 12 to keep the first and second products 50 and 52 secured within pack 12 and prevent the contents of the first product 50 (e.g., body wash) in the first cavity 20 from leaking into the second cavity 30 and potentially damaging the second product 52 (e.g., razor cartridges). A user may gain access to the first and second products 50 and 52 by pealing the cover 60 from the outer flange member 16 of the pack 12 or by cutting the cover 60. Perforations in the cover 60 may be provided to facilitate access to the pack 12. In certain embodiments, the cover 60 may be injection molded or thermoformed from a clear polymer material, including, but not limited to polyvinyl chloride (PVC), polyethylene terephthalate (PET), high density polyethylene (HDPE), and low density polyethylene (LDPE), polypropylene (PP), or any combination thereof. Alternatively, the cover 60 may include a flat or formed paperboard or polymeric material with a heat sealable coating and/or an anti-theft coating. The cover 60 may also include thin polymeric films that are sealed to the pack 12.

Figure 3:
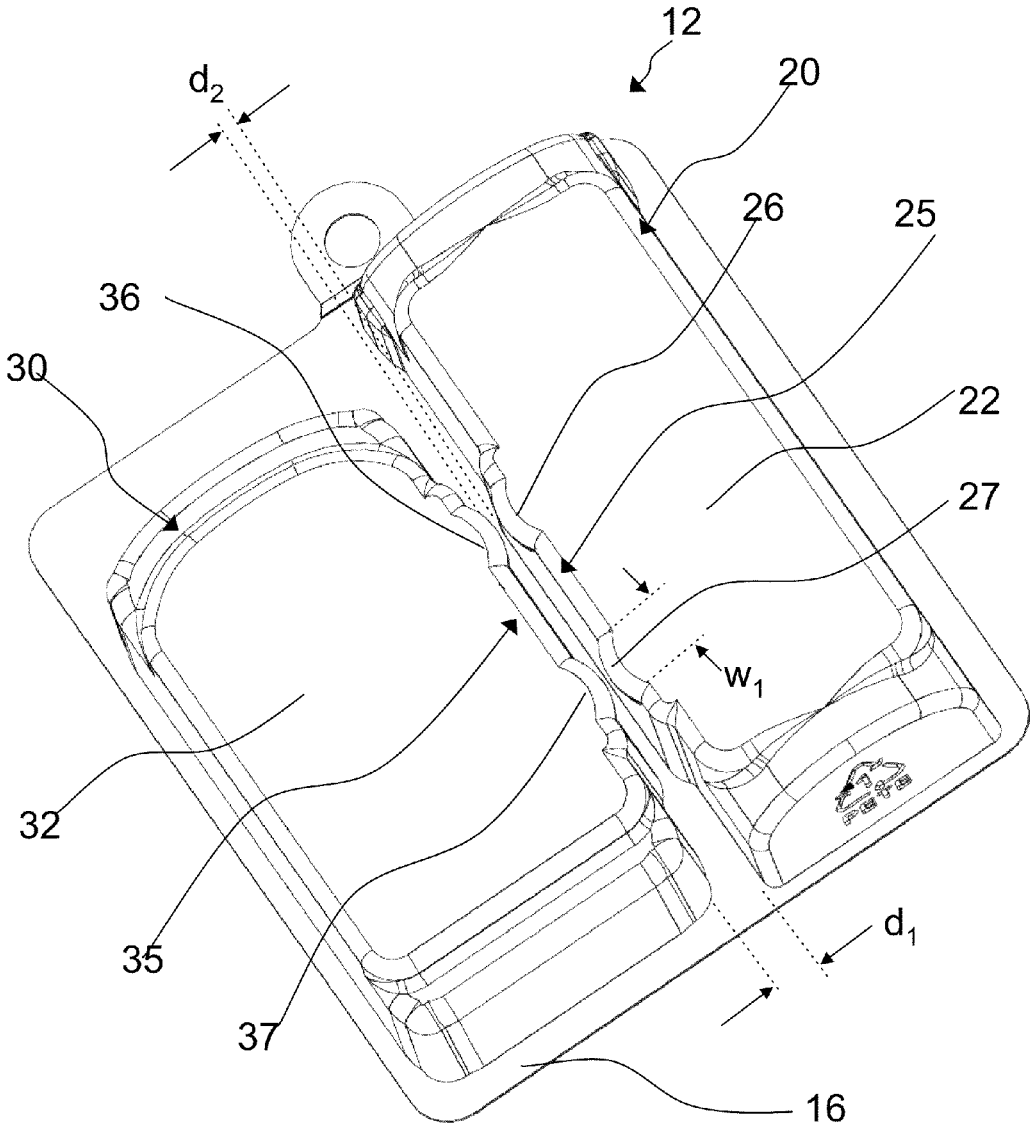
FIG. 3 is a bottom perspective view of a pack which may be incorporated into the co-packaged article of FIG. 2.

Co-packaged articles can present special challenges because separated cavities are often needed to ensure that the contents of a product disposed in one cavity does not enter into an another cavity. Thermoformed packs that have separated cavities have a tendency to bow and flex during assembly and shipment, which may distort the label 40 or loosen the cover 60 or the label 40 from the pack 12. Although the label 60 may minimize or prevent outward flexing of the cavities 20 and 30 relative to each other (as previously described), other features may be needed to minimize inward flexing of the cavities 20 and 30. Referring to FIG. 3, in certain embodiments, the first and second cavities 20 and 30 of the pack 12 may have one or more spaced apart internals walls 25 and 35 (respectively) that separate the first and second products 50 and 52 (see FIG. 1) within the respective first and second cavities 20 and 30. The internal walls 25 and 35 may be spaced apart by a distance $d_1$ of about 2 mm, 3 mm, or 4 mm to about 5 mm, 6 mm, or 7 mm. The distance between the internal walls 25 and 35 may taper from a larger dimension at the outer surfaces 22 and 32 to a smaller dimension at the outer flange member 16. The internal walls 25 and 35 may be straight, actuate, parallel, or nonparallel.

The internal wall 25 of the first cavity 20 may have at least one protrusion 26 that projects laterally from the internal wall 25 of the first cavity 20 toward the internal wall 35 of the second cavity 30. The internal wall 35 of the second cavity 30 may have at least one protrusion 36 that projects laterally from the internal wall 35 of the second cavity 30 toward the internal wall 25 of the first cavity 20. In certain embodiments, the protrusions 26 and 36 may be mirror images and may project toward each other. The protrusions 26 and 36 may provide for a more rigid pack 12 by limiting inward flexing of the pack 12. For example, the protrusions 26 and 36 may act as stop surfaces as forces are applied to the pack 12 during shipping and handling. The first and second cavities 20 and 30 may flex inward as force is applied, but the protrusions 26 and 36 may contact each other to limit further inward flexing which may damage the Larger packs, packs for holding of displaying numerous products (e.g., three or more), or packs that are required to securely hold and display heavier items may require more protrusions to limit inward flexing. For example, the internal walls 25 and 35 of the first and second cavities 20 and 30 (respectively) may each have a plurality of spaced apart protrusions that further decrease distortion of the pack 12 (i.e., inward flexing). The internal wall 35 of the second cavity 30 may have a second protrusion 37 that projects laterally toward the internal wall 25 of the first cavity 20. The internal wall 25 of the first cavity 20 may a second protrusion 27 that projects laterally toward the internal wall 35 of the second cavity 30. In certain embodiments, the protrusions 27 and 37 may be mirror images and may project toward each other. The protrusions 26 and 27 that project from wall 25 may be spaced apart from each other by about 4 mm, 6 mm, or 8 mm to about 10 mm, 15 mm, or 20 mm. The protrusions 26, 27, 36 and 37 may be arcuate (e.g., dome shaped) or straight. A domed shape protrusion may provide for improved manufacturability and greater structural integrity to prevent the pack 12 from flexing. The protrusions 26, 27, 36 and 37 may have a width $w_1$ of about 5 mm, 7 mm, or 10 mm to about 15 mm, 20 mm, or 25 mm. It is understood that the width of the protrusions 26, 27, 36 and 37 may be larger or smaller depending on the size of the pack 12 (e.g., a larger pack 12 may require $w_1$ to be larger). In certain embodiments, the protrusions 26 and 36 may be spaced apart from each other (or the opposite internal wall 25 or 35) a distance $d_2$ of about 0.2 mm, 0.5 mm, 1.0 mm, to about 1.5 mm, 3.0 mm, or 4 mm. The protrusions 27 and 37 may be spaced apart from each other (or the opposite internal wall 25 or 35) by a similar distance. The protrusions 26 and 36 may have a first position and a second position. In the first position, the protrusions 26 and 36 may be spaced apart from each other (or the opposite internal wall 25 or 35). In the second position, the protrusions 27 and 37 may contact each other (and/or the opposite internal wall 25 or 35) to limit inward flexing of the cavities 20 and 30 toward each other. The 27 and 37 may also have a first position and a second position, as described for protrusions 26 and 36. If the protrusions 36 and 37 are spaced too far apart from the opposing protrusions 26 and 27 (or the opposing internal wall 35) the internal flexing of the cavities 20 and 30 may not be limited sufficiently to prevent distortion and/or damage to the pack 12.

Under certain conditions, the protrusions 26 and 36 and the protrusions 27 and 37 may be contacting (i.e., a distance $d_2$ of zero), but not integral. For example, the protrusions 26 and 27 of the internal wall 25 may be spaced apart from the protrusions 36 and 37 of the internal wall 35 after thermoforming. Once the label 40 (see FIG. 1) is applied to the outer surfaces 22 and 32, the label 40 may draw the internal walls 25 and 35 toward each other such that the protrusions 26 and 27 contact the respective protrusions 36 and 37. The internal walls 25 and 35 may remain spaced apart even if the respective 26, 27, 36, 37 protrusions are contacting.

The demand for recyclable packaging materials is constantly increasing. Currently it is difficult to manufacture packages (e.g., blister packs) that are recyclable (e.g., paperboard) and have sufficient strength to hold and display heavier articles. The co-packaged article 10 provides a more rigid construction by limiting inward and/or outward flexing of the pack 12. The inward and/or outward flexing of the cavities 20 and 30 can be limited for a pack 12 that is manufactured (e.g., thermoformed) from weaker materials (e.g., paperboard or other recycled materials). The increased rigidity may also allow for the pack 12 to be thermoformed from a thinner sheet of material, thus saving additional material and costs.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A pack for co-packaged article comprising:

an inner flange member;

an outer flange member;

a first cavity defined by the inner flange member and the outer flange member, the first cavity having a flat outer surface and a first internal wall;

a second cavity defined by the inner flange member and the outer flange member, the second cavity having a flat outer surface and a second internal wall spaced apart from the first internal wall, the second internal wall has at least one protrusion with a first position and a second position, wherein the protrusion is spaced apart from the first internal wall in the first position and contacts the first internal wall in the second position limiting inward flexing of the first and second cavities toward each other; and a label joined to the flat outer surface of the first cavity and the flat outer surface of the second cavity and limits outward flexing of the first and second cavities.

2. The pack of claim 1 wherein the protrusion of the second cavity is spaced apart from the first internal wall by about 0.2 mm to about 4 mm in the first position.

3. The pack of claim 1 wherein the first internal wall has at least one protrusion that is spaced apart from the protrusion of the second internal wall in the first position and contacts the protrusion of the second internal wall in the second position limiting inward flexing of the cavities toward each other.

4. The pack of claim 1 wherein the first and second internal walls each has at least two spaced apart protrusions.

5. The pack of claim 4 wherein the protrusions of the first internal wall are spaced apart from the protrusions of the second internal wall in the first position and contact the protrusions of the second internal wall in the second position limiting inward flexing of the cavities toward each other.

6. The pack of claim 5 wherein the protrusions of the first cavity are spaced apart from the protrusions of second cavity by about 0.2 mm to about 4 mm.

7. The pack of claim 6 wherein the label is a pressure sensitive adhesive that is at least partially transparent.

8. A co-packaged article comprising:

a first product;

a second product;

a pack having an internal flange member and an outer flange member defining a first cavity dimensioned to receive the first product and a second cavity dimensioned to receive the second product, the first cavity having a flat outer surface and a first internal wall with at one least one protrusion projecting laterally from the first internal wall, the second cavity having a flat outer surface and a second internal wall spaced apart from the first internal wall, the second internal wall having at least one protrusion projecting laterally toward the protrusion of the first internal wall;

a cover joined to the outer flange member; and a label joined to the flat outer surfaces of the first and second cavities wherein the protrusion of the second internal wall contacts the first internal wall limiting inward flexing of the first and second cavities and the label limits outward flexing of the first and second cavities.

9. The co-packaged article of claim 8 wherein at least one of the protrusions is arcuate.

10. The co-packaged article of claim 8 where the cover is joined to the internal flange member.

11. The co-packaged article of claim 8 further comprising a hanging member.

12. The co-packaged article of claim 8 wherein the protrusion of the first cavity is spaced apart from the protrusion of second cavity by about 0.5 mm to about 4 mm.

13. The co-packaged article of claim 8 wherein the protrusions are contacting.

14. The co-packaged article of claim 8 wherein at least one of the first and second internal walls has at least two protrusions.

15. The co-packaged article of claim 8 wherein the pack has a hanging member defining an opening extending therethrough.

16. A pack for a co-packaged article comprising:

an inner flange member;

an outer flange member;

a first cavity defined by the inner flange member and the outer flange member, the first cavity having a flat outer surface and a first internal wall;

a second cavity defined by the inner flange member and the outer flange member, the second cavity having a flat outer surface and a second internal wall spaced apart from the first internal wall and the first internal wall has a pair of spaced apart protrusions projecting laterally toward a pair of corresponding protrusions on the second internal wall; and a label joined to the flat outer surfaces of the first and second cavities limiting outward flexing of the first and second cavities, wherein the pair of spaced apart protrusions on the first internal wall contact the pair of corresponding protrusions on the second internal wall limiting inward flexing of the first and second cavities.

17. The pack for a co-packaged article of claim 16 wherein at least one of the protrusions is arcuate.

18. The pack for a co-packaged article of claim 16 further comprising a cover joined to the internal flange member or the outer flange member.

19. The pack for a co-packaged article of claim 16 wherein at least one of the protrusions of the first cavity is spaced apart from the protrusion of second cavity by about 0.5 mm to about 4 mm in a first position and the pair of spaced apart protrusions on the first internal wall contact the pair of corresponding protrusions on the second internal wall in a second position.

* * * * *